United States Patent [19]

Widmer

[11] 4,331,089

[45] May 25, 1982

[54] DEVICE FOR SIMPLIFICATION OF SEWING MACHINE ADJUSTMENTS AND SET-UP

[75] Inventor: Hans Widmer, Magglingen, Switzerland

[73] Assignee: Fritz Gegauf AG Bernina-Naehmaschinenfabrik, Steckborn, Switzerland

[21] Appl. No.: 154,337

[22] Filed: May 29, 1980

[30] Foreign Application Priority Data

Jun. 6, 1979 [CH] Switzerland ..... 5252/79

[51] Int. Cl.[3] ..... D05B 19/00; D05B 3/02; D05B 47/04

[52] U.S. Cl. ..... 112/121.11; 112/158 A; 112/158 E; 112/158 F

[58] Field of Search ..... 112/158 E, 158 F, 254, 112/275, 158 A, 121.11, 121.12

[56] References Cited

U.S. PATENT DOCUMENTS 3,613,610 10/1971 Hinerfeld et al. .

3,871,310 3/1975 Hanyu .

4,079,683 3/1978 Hanyu et al. .

4,100,865 7/1978 Landau, Jr. et al. .

4,166,423 9/1979 Brienza et al. .

4,173,193 11/1979 Morinaga et al. ..... 112/275

4,236,467 12/1980 Tanaka et al. ..... 112/158 E

*Primary Examiner*—Peter P. Nerbun

*Attorney, Agent, or Firm*—Wender, Murase & White

[57] ABSTRACT

The device for simplification of adjustment and set-up of a sewing machine comprises a keyboard allowing introduction of information relating to the sewing operation to be performed to the material to be sewn and the like. The information introduced are applied to addresses of memory means, and data relating to the adjustment and set-up of the sewing machine are transmitted to adjusting means and displays illustrating set-up and adjustment. The sewing machine is automatically adjusted and may be set-up by the operator in accordance with the setting-up data indicated on displays provided on the sewing machine. In this way, adjustment and setting-up of the sewing machine is rendered easy and reliable.

12 Claims, 10 Drawing Figures

DEVICE FOR SIMPLIFICATION OF SEWING MACHINE ADJUSTMENTS AND SET-UP

BACKGROUND OF THE INVENTION

This invention concerns a device for simplified adjustment and set-up of a sewing machine with known drive and control systems in conjunction with machine parts and adjustment devices assigned to these control systems. The adjustment possibilities of modern sewing machines with regard to the sewing operation and material to be sewn are so extensive that for a minimum number of typical sewing operations and materials, the operator must be provided with data on machine adjustment, the use of certain accessories, a particular thread type and similar operations. Such data is commonly provided in a table on the inside of a hinged cover of the sewing machine (U.S. Pat. No. 4,079,683) or in the form of a folded table under the cover (U.S. Pat. No. 3,871,310). However, such tables are disadvantageous for various reasons. Only a very limited number of combinations of sewing operation prerequisites for adjustment and set-up instructions can be compiled in such a table. The larger the table and consequently the combination of predefinable conditions and readable information, the more unsurveyable, thus increasing the possibilities for errors to occur. It is not especially practical if additional operations in the machine must be performed for machine set-up, e.g. the opening of a cover. Errors, mistakes and omissions can easily occur when individual adjustment units are set-up according to numerical table data.

SUMMARY OF THE INVENTION

The objective of this invention is to prevent the above-mentioned disadvantages of existing concepts by creating a device which handles a substantially broader scope of data and simultaneously precludes reading and/or adjustment errors and the need for additional machine alterations by ensuring automatic sewing machine adjustments.

This objective is attained by an input device for different variable data such as material type, sewing operation to be performed, etc. and memories which are addressed and programmed by the input unit. These memories handle storage of optimum adjustment values or ranges which are necessary for performing different sewing operations on different materials and which are required for the sewing machine as well as operation-related accessories such as the foot, needle, thread, etc. The device is also distinguished by adjustment mechanisms as well as optical displays assigned to set-up devices located to some extent on the sewing machine. These adjustments can be memory-controlled for adjusting machine parts within the above-mentioned adjustment values or ranges and their displays are also memory-controlled for indication of the necessary accessories.

Individual data or conditions for the sewing operation can be consecutively entered after which machine parts are automaticlly adjusted; instructions are unmistakeably displayed preferably on the adjustment and setup devices themselves, thus precluding the possibility of errors and thereby ensuring optimum machine adjustment and set-up even by personnel with limited experience in sewing machine operation.

A more detailed description of the invention will now be given on the basis of the example in the illustration.

DESCRIPTION OF THE PREFERRED EMBODIMENT

Figure 1:
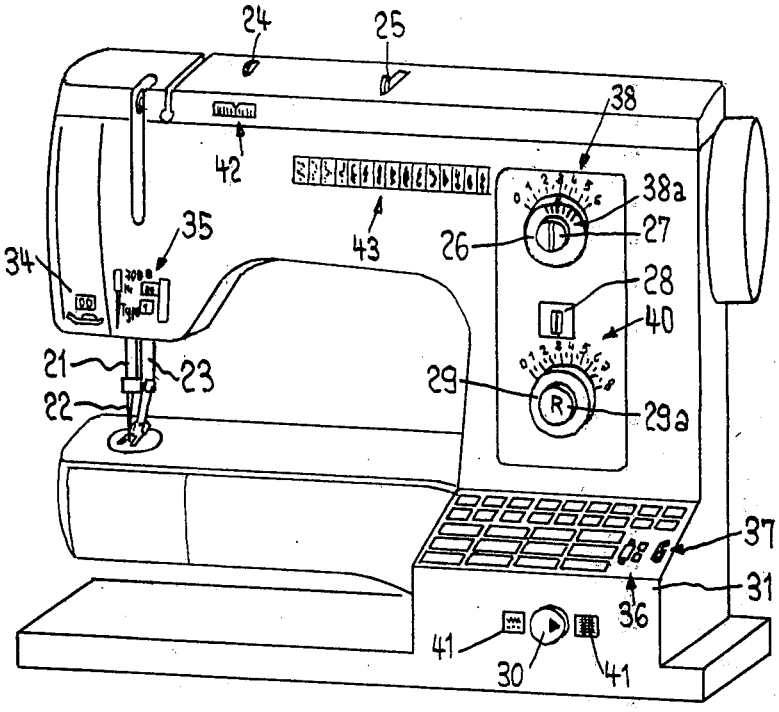
FIG. 1 shows a perspective view of the sewing machine.

The sewing machine shown in FIG. 1 has conventional adjustment and set-up elements, i.e. needle bar 21 which permits attachment of needle 22; pressor foot bar 23 which accepts the replaceable foot; adjustment thumbwhell 24 for thread tensioning; selection lever 25 for standard and fancy stitching; rotary adjustment knobs 26 and 27 for stitch width and needle deflection; adjustment knob 29 for stitch length selection; selector knob **29*a* for switchover to reverse stitching and switchover knob 30 for sewing or darning/freehand stitching. Buttonhole symbol 28** is anticipated in place of a control knob for buttonhole sewing and illuminates when selecting a buttonhole program. The buttonhole is automatically sewn in the conventional manner according to the size of the button inserted in the buttonhole foot.

Figure 2:
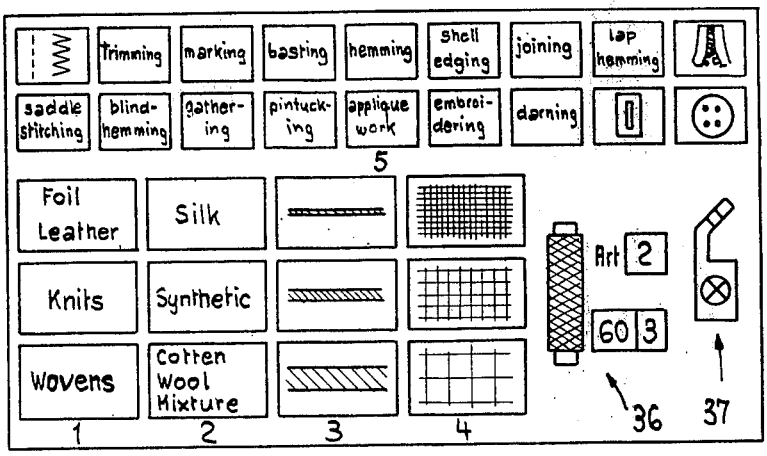
FIG. 2 shows a top view of the keyboard in larger scale.

A keyboard with sections 1–5 is located on the protruding panel 31 of the housing. As shown in FIG. 2, section 1 pushbuttons permit data entry of material type, i.e. wovens, knits and foil or leather. Section 2 pushbuttons permit the entry of additional data on material type, i.e. cotton, wool or mixture, synthetics or silk. Section 3 pushbuttons permit data entry of material thickness, i.e. lightweight, medium and thick material. Section 4 pushbuttons permit data entry of the density of wovens or knits. Section 5 pushbuttons permit data entry of the many diverse sewing operations indicated in part by symbols and in part by words.

The LED or liquid crystal displays comprise a display 34 on the machine housing above the foot. This 2-digit display is designated by a foot symbol and indicates the foot number provided on the foot by suitable means. Display 35 located above the needle bar is the needle display which is also designated by a symbol. A 2-field display indicates needle thickness and type. Display 36 located on the housing section 31 indicates the thread to be used and is also identified by a symbol. A 3-field display provides additional data on the strength and quality of the thread to be used. Needle and thread types are digitally displayed in code for which the key text is located on the unit itself, on the accessory container or in the operating instructions. Display 37 is activated when the bobbin thread guide designated by a stylized symbol must be used for sewing operations, e.g. buttonhole sewing. Displays 38 and **38*a* designed as scales for the respective adjustment knobs 26 and 27 have a number of display fields which can be individually activated to display the stitch width and needle deflection. Display 28 illuminates when the buttonhole program is selected. Display 40 which has a scale of individually operative fields, indicates stitch length, whereby the scale position of adjustment element 29** must correspond with the position on the scale of display 40. Display 41 indicates the position in which adjustment element 30 must be set for material feed to be operative or inoperative; one position is for darning and freehand stitching and the other is for sewing. Display 42 indicates the thread tension and the value to be adjusted between 0–8 is indicated by an illuminated field of the scale. Thread tensioning can be adjusted by thumbwheel 24 immediately adjacent to the display. Display 43 indicates the number or symbol of the stitch pattern to be set.

All adjustment elements **24, 25, 26, 27, 29, 29*a* and 30 have an electromechanical adjustment mechanism. The electronics system located in housing section 31** has a memory for storage of instructions assigned to different combinations of data to be entered for sewing machine adjustment. These instructions contained in the memories can control adjustment mechanisms used for adjusting the assigned elements into the proper positions as well as the control of above-mentioned displays of these adjustment mechanisms or elements.

Figure 3:
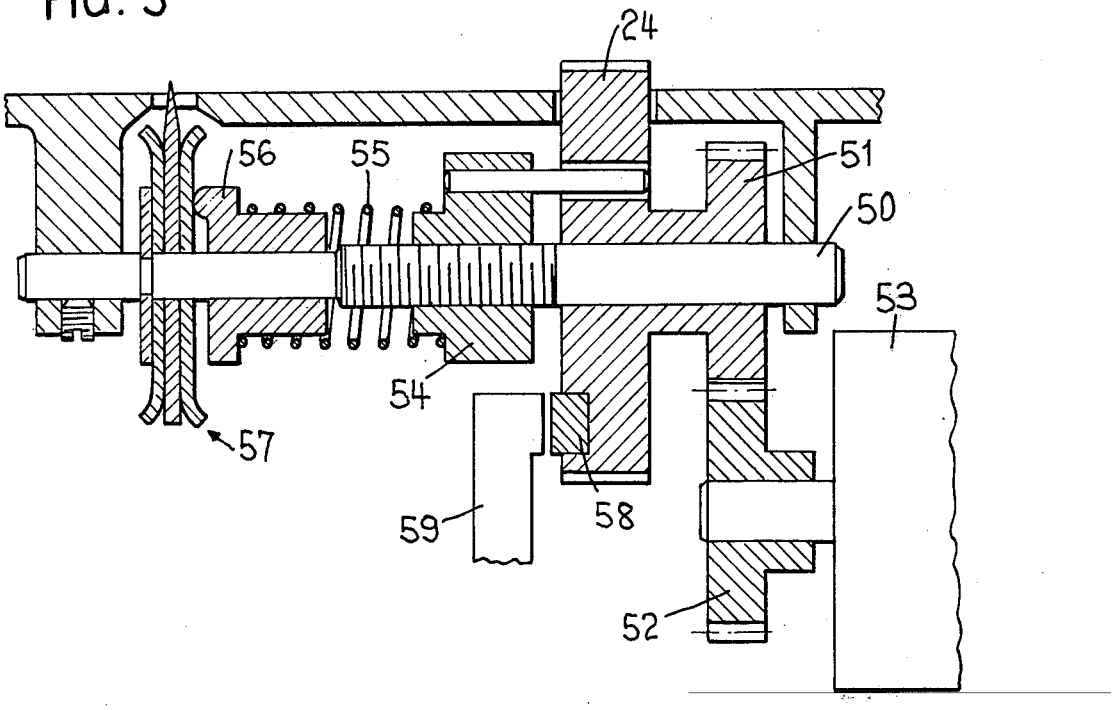
FIGS. 3–8 show adjustment mechanims used for machine part adjustment.

FIGS. 3–8 show the electromechanical adjustment mechanisms assigned to the adjustment elements which are designed as stepper motors, electromagnets or other motors and are described in the following examples:

FIG. 3 shows the thread tensioning adjustment mechanism. Wheel 24 shown in FIG. 1 is rotary-mounted on spindle 50 and is designed as a one-piece unit with gear wheel 51 which engages in gear wheel 52 on the shaft of stepper motor 53. Wheel 24 is coupled to nut 54 located on the threaded section of spindle 50. Nut 54 acts on the thread tension disk by means of spring 55 and sleeve 56. Permanent magnet 58 installed in wheel 24 acts together with a positioning sensor 59 which displays the zero position of wheel 24 if permanent magnet 58 is opposite to positioning sensor 59. By manual rotation of wheel 24 or automatic rotation by means of stepper motor 53, nut 54 is rotated on spindle 50 and is axially shifted so that thread tensioner 57 is more or less tensioned. During each automatic adjustment procedure, stepper motor 53 first proceeds into the zero position in the initialization phase and then makes the required number of steps from this position.

Figure 4:
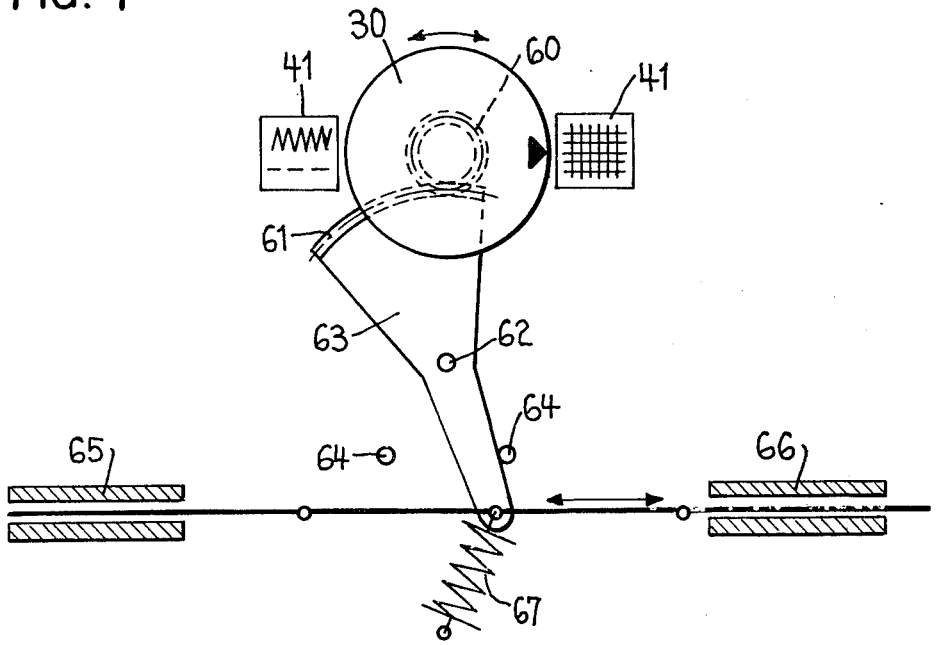

FIG. 4 shows switchover knob 30 for preselecting sewing or darning/freehand stitching. Pinion 60 with which toothed segment 61 engages in one of the levers 63 mounted on pin 62 is located on the shaft of switchover knob 30. The limit positions of lever 63 are defined by stop pins 64. Two electromagnets 65 and 66 can influence lever 63, and the limit positions of the lever are determined by toggle lever compression spring 67 which, in turn, acts on it. Switchover can be performed either manually or by keyboard preselection according to FIG. 2. In the latter case, one or the other magnet 65 or 66—according to the preselection—is activated and lever 63 is switched over if it is not already in the correct position. When lever 63 is tilted, switchover knob 30 is rotated by 180° into the other operating position by toothed segment 61 and pinion 60.

Figure 5:
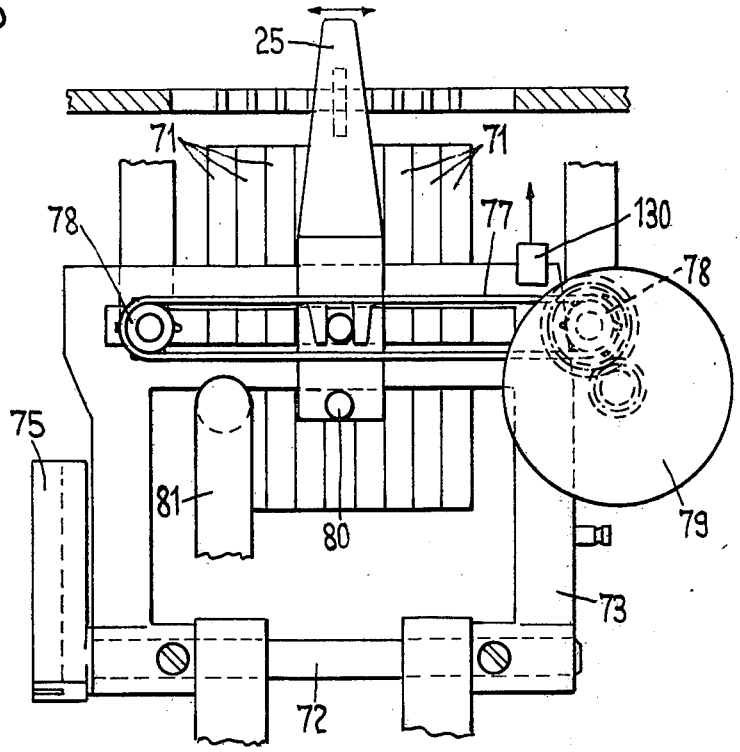
Figure 6:
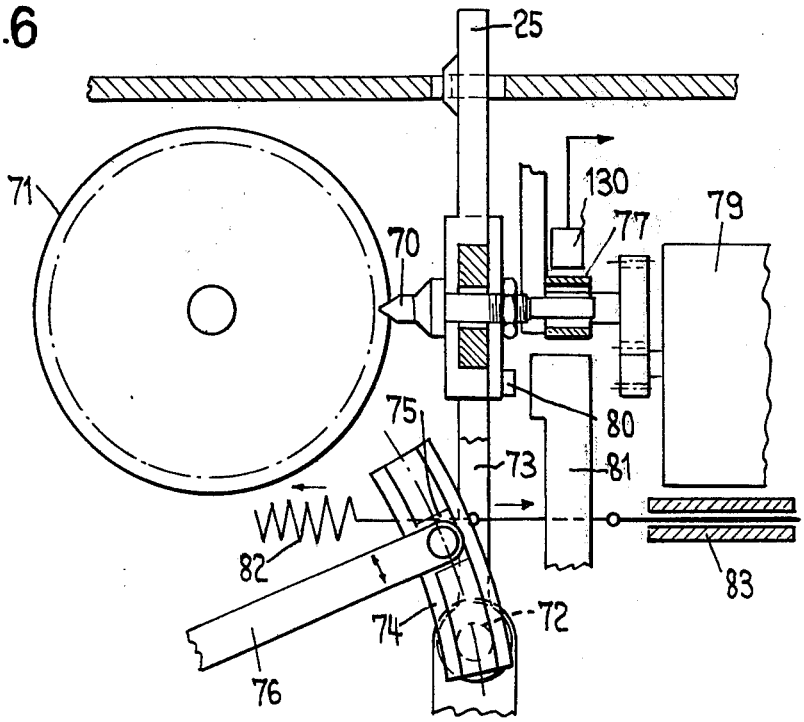

FIGS. 5 and 6 show the adjustment mechanism for adjusting selector lever 25 or for preselection of certain standard and fancy stitches. Lever 25 with sensor 70 which acts together with one cam disk of cam disk set 71 can be shifted on rocker frame 73 fastened to spindle 72. Spindle 72 is also connected to zigzag slide 74 which transfers the zigzag motion with varying amplitude according to the rocker arm position via rocker arm 75 (see FIG. 6) and rod 76. One chain link or hole of perforated belt 77 engages at lever 25. The chain travels over sprocket wheels 78 one of which can be driven by stepper motor 79. Permanent magnet 80 located on lever 25 is only situated in front of positioning sensor 81 if sensor 70 of the lever 25 is on the first cam disk 71. Tension spring 82 acts on rocker frame 73 which usually maintains contact between sensor 70 and a cam disk. However, the rocker frame can be tilted clockwise by means of electromagnet 83 laterally lifting sensor 70 into a position removed from the cam disk set to permit rocker frame adjustment. Electromagnet 83 is activated for automatic readjustment after which stepper motor 70 shifts lever 25 and sensor 70 into the zero position by means of perforated belt 77. Elements 80 and 81 report this status to the electronics system. Then, step-by-step adjustment is performed to the preselected position, whereby sensor 70 is brought into the zone of desired cam disk 71.

Figure 7:
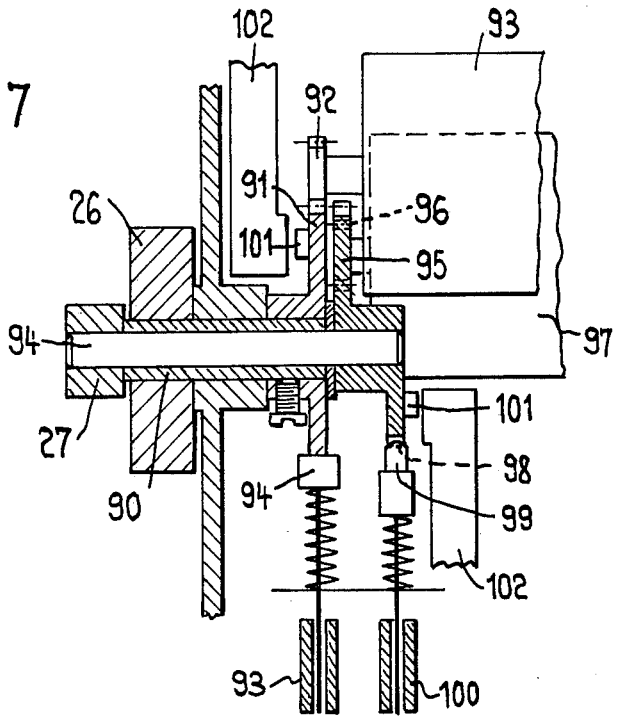

FIG. 7 shows the adjustment mechanism for adjustment knobs 26 and 27 for the stitch or zigzag width or the needle deflection. Adjustment knob 26 is located on hollow shaft 90 together with toothed segment 91 which can be driven by stepper motor 93 via pinion 92. The spring-loaded brake which can be activated by electromagnet 93 acts on toothed segment 92. Toothed segment 92 adjusts stitch width in the well-known manner by means of the linage which is not illustrated. Adjustment knob 27 is located on spindle 94 to which toothed segment 95 is also attached. Pinion 96 of stepper motor 97 engages in toothed segment 95. Toothed segment 95 is provided with engagement toothing 98 into which a spring-loaded engagement pin 99 engages. This pin can be actuated by electromagnet 100. Toothed segment 95 adjusts the needle deflection in a well-known manner by means of a linkage which is not depicted. Both toothed segments 91 and 95 are each provided with a magnet 101 which acts on a positioning sensor 102. To adjust stitch width and needle deflection, electromagnets 93 and 100 are activated to release the respective toothed segment after which the assigned stepper motors 93 or 97 first bring the segment into the zero position. This status is reported by positioning sensor 102 and the stepper motor then brings the assigned toothed segment into the preselected position so that adjustment is obtained.

Figure 8:
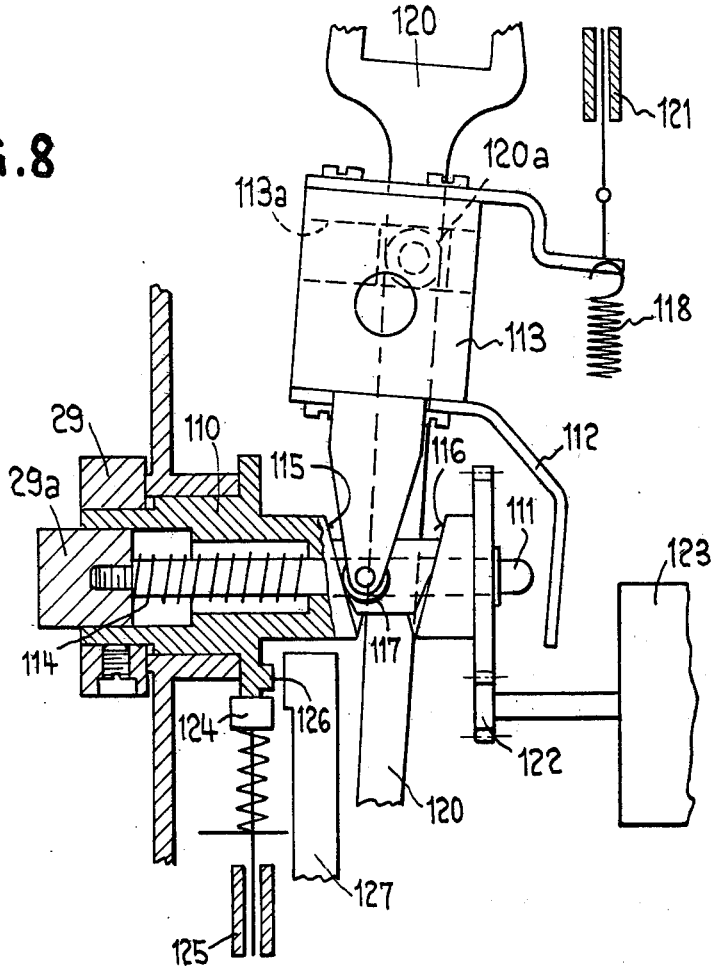

FIG. 8 shows the adjustment mechanism required for stitch length preselection. Adjustment knob 29 is positioned on hollow shaft 110 while knob **29*a* is located on rod 111 which passes through shaft 110. The inner end of rod 111 acts together with bracket 112 of stitch position slide 113. Return spring 114 acts on knob 29*a*. Hollow shaft 110 has a control groove limited by two opposing, inclined surfaces 115 and 116. Normally, sensor 117 of stitch position slide 113 makes contact with surface 115 due to tension spring 118 which controls normal advance sewing if guide groove 113*a* of stitch position slide 113 is inclined for rocker arm 120*a* of stitch position fork 120 according to FIG. 8. The inclination of groove 113*a* and thereby the stitch length can be selected in a well-known manner by rotating hollow shaft 110 or its surface 115, thus adjusting the inclination of stitch position slide 113. By actuating knob 29*a* or activation of electromagnet 121, stitch position slide 113 can be temporarily pivoted into the opposite, inclined position in which case sensor 117 makes contact with surface 116 and reverse sewing with shorter or longer stitches results. Hollow shaft 110 is provided with gear wheel 119 which is engaged in pinion 112 or stepper motor 123. Spring-loaded brake 124 acts on a flange of hollow shaft 110 and can be actuated by an electromagnet 125. Furthermore, a zero position indicator with magnet 126 and positioning sensor 127 is anticipated. For automatic stitch length adjustment, brake 124 is released by activation of magnet 125 after which stepper motor 124 first brings the hollow shaft into the zero position and then into the preselected position. By activation of magnet 121 switchover to reverse sewing can be accomplished by activating magnet 121**.

A positioning annunicator can be anticipated in all cases which responds when the desired position is obtained and reports this status to the electronics system. Such an annunciator 130 is illustrated as an example in FIGS. 5 and 6. This device reads code indications from perforated belt 77 and transmits coded position signals to the electronics system. Position annunciators can be anticipated for other adjustment mechanisms whereby code indications are provided on gear wheels, flanges and similar units or on special code disks.

The machine can be activated in the automatic buttonhole sewing mode according to FIG. 2 by pushbutton actuation, e.g. according to one of the U.S. Pat. Nos. 4,182,087, 3,841,146 or 4,056,070, whereby a display can illuminate above presser foot bar 23, thereby indicating that a respective foot must be mounted for buttonhole sewing.

Figure 9:
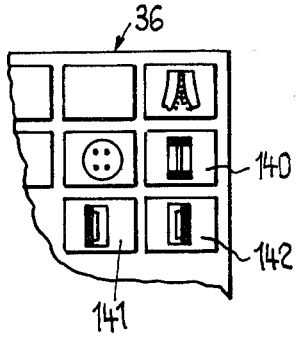
FIG. 9 shows a section of the keyboard model variant.

However, instead of only one pushbutton, three pushbuttons for buttonhole sewing can be anticipated in a slightly modified keyboard according to FIG. 9, whereby pushbutton 140 controls adjustment for each of the buttonhole bar tack stitches; and pushbuttons 141 and 142 control left and right bead stitching. In this case, the operator must only actuate the respective pushbutton and the adjustment for the individual sewing operation to be carried out is automatically performed by means of the above-mentioned mechanisms. It would also be possible to control the adjustment for individual operations by repeated actuation of a single pushbutton assigned to buttonhole sewing according to FIG. 2.

To perform sewing machine adjustment, the operator enters all data by means of pushbuttons 1–5, i.e. material type, material thickness and sewing operaton to be performed. When this procedure is completed, i.e. after the corresponding pushbuttons of sections 1–5 have been actuated, the display for sewing machine adjustment and set-up automatically appears. The individual displays have already been discussed. If necessary, the operator interchanges accessories and thread and checks adjustments according to displays 28–33. Adjustment can be adapted to special conditions if required.

It is obviously apparent that the described device permits highly diverse selection of conditions and displays of instructions under the preclusion of errors.

Should special conditions not permit mounting on the sewing machine, the keyboard and electronics system could be accommodated in a separate unit connected to the sewing machine by a fixed or movable power cord.

Displays 36 and 37 can be situated at other positions on the sewing machine and more precisely near those positions where thread or bobbin thread guide are located.

Figure 10:
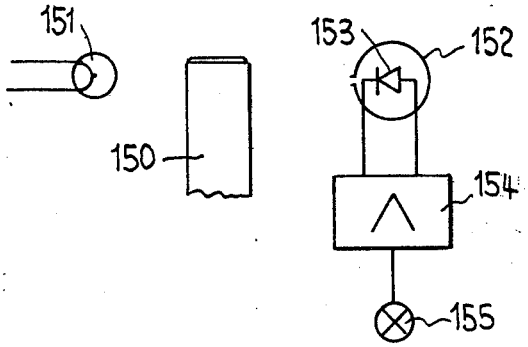
FIG. 10 shows a schematic of a monitoring system.

A different input system, e.g. one which employs sensors, a telephone dial or similar devices can be used in place of the described keyboard. Variable data can be recorded on a digit conversion table and input in this case occurs in digital sequence, i.e. with the above-mentioned dial. The digit conversion table can be provided on a section of the sewing machine or on the above-mentioned device. An annunciator system with an optical signal transmitter could be anticipated which checks and indicates whether or not the sewing machine is properly adjusted to perform the sewing operation to be carried out, i.e. whether all adjustments have been carried out according to instructions contained in the memories. It may be advantageous to contemplate sequential data entry and/or to provide for sequential sewing machine adjustments as well as display of required accessories. Sequential data entry would be possible with a substantially simplified and clearly surveyable keyboard, and sequential adjustment permits operation with relatively minimal power output and simplified electronics system so that the design of the device can be relatively compact. Automatic sewing machine adjustment shall only occur if the needle bar is in the upper limit position or at any rate in the vicinity of this position. Such an interlock can only occur if the upper end of the needle bar is sensed in its limit position by a light barrier which disables electronics system outputs when the needle bar is not in the light barrier. A respective schematic of this concept is shown in FIG. 10. In the upper limit position, the upper end of needle bar 150 enters between light source 151 and casing 152 provided with a light entry slot. Photodiode 153 controls signal lamp 155 by means of amplifier 154. The circuit can operate in such a manner that the signal lamp is illuminated as long as the needle bar is not in the upper limit position.

What I claim:

1. A device for simplifying adjustment and set-up of a sewing machine having drive and control systems, machine parts involved in sewing operations, adjusting devices coupling the drive and control systems to the machine parts, and manually operated adjustment elements coupled to the adjusting devices, comprising:

an input unit having a plurality of means for manually producing data fully characterizing a material type and any type of sewing operation desired to be performed;

memory means accessed by said data produced by said input unit and in which is stored all optimum sewing machine adjustment values including ranges for performing any selected sewing operation on different materials in addition to corresponding accessory data characterizing foot, needle and thread settings;

optical display means located at least to some extent on the sewing machine and connected to said memory means for displaying said corresponding accessory data; and adjustment mechanisms coupled to the adjusting devices and controlled by said memory means for adjusting at least some of the machine parts in accordance with said adjustment values and ranges, whereby adjustment and set-up of the sewing machine can be automatically performed.

2. A device according to claim 1, further comprising at least one display unit cooperating with one of said adjustment elements to indicate said adjustment values and ranges.

3. A device according to claim 2, wherein said display unit is an optical scale having a plurality of display elements each of which may be individually activated.

4. A device according to claim 1, wherein said adjustment mechanisms include stepper motors.

5. A device according to claim 1, wherein said adjustment mechanisms include electromagnets cooperating with the adjustment devices.

6. A device according to claim 1, further comprising a safety circuit which permits automatic adjustment and set-up of the adjusting devices of the sewing machine only if said needle is positioned within a predetermined zone.

7. A device according to claim 6, wherein said safety circuit includes an optical display which is activated if said needle is outside said predetermined zone.

8. A device according to claim 1, wherein the adjustment devices for controlling at least stitch width and stitch length can be manually operated in addition to automatic operation by said adjustment mechanisms so that minor corrections can be performed.

9. A device according to claim 1, wherein said optical display means is a digital display.

10. A device according to claim 1, further comprising an annunciator system having an optical signal transmitter for indicating whether the sewing machine has been adjusted and set-up in accordance with said type of sewing operation desired to be performed.

11. A device according to claim 1, wherein said input unit is adapted for sequential data input.

12. A device according to claim 1, wherein said optical display means is adapted to sequentially display said corresponding accessory data.

* * * * *